US009340389B2

(12) United States Patent
Bixler et al.

(10) Patent No.: US 9,340,389 B2
(45) Date of Patent: May 17, 2016

(54) CORELESS TISSUE ROLLS

(71) Applicant: Kimberly-Clark Worldwide, Inc., Neenah, WI (US)

(72) Inventors: Gregory Michael Bixler, Appleton, WI (US); Daniel Mark Heinz, Greenville, WI (US); Vivek Moreshwar Karandikar, Neenah, WI (US); Frank Stephen Hada, Appleton, WI (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 91 days.

(21) Appl. No.: 14/255,676

(22) Filed: Apr. 17, 2014

(65) Prior Publication Data

US 2014/0224919 A1 Aug. 14, 2014

Related U.S. Application Data

(63) Continuation of application No. 12/606,515, filed on Oct. 27, 2009, now Pat. No. 9,126,792.

(51) Int. Cl.

| | |
|---|---|
| ***B65H 19/22*** | (2006.01) |
| ***B65H 19/28*** | (2006.01) |
| ***B65H 18/28*** | (2006.01) |

(52) U.S. Cl.

CPC ..... *B65H 19/28* (2013.01); *B65H 18/28* (2013.01); *B65H 19/2276* (2013.01); *B65H 2301/41426* (2013.01); *B65H 2301/41484* (2013.01); *B65H 2701/5112* (2013.01)

(58) Field of Classification Search

CPC ..... B65H 19/28; B65H 19/2276

USPC ..... 242/533.4–533.5, 554.3–554.6, 559.2

See application file for complete search history.

(56) References Cited

U.S. PATENT DOCUMENTS

| | | | |
|---|---|---|---|
| 1,592,359 | A | 7/1926 | Hawk |
| 2,971,719 | A | 2/1961 | Cochrane et al. |
| 3,062,471 | A | 11/1962 | Loop |
| 4,097,983 | A | 7/1978 | Cole |
| 4,177,897 | A | 12/1979 | Cole |
| 5,374,006 | A | 12/1994 | Mheidle |
| 6,595,458 | B1 | 7/2003 | Biagiotti |
| 2007/0152094 | A1 | 7/2007 | Deacon |

FOREIGN PATENT DOCUMENTS

| | | | |
|---|---|---|---|
| EP | 0 698 367 | A1 | 2/1996 |
| GB | 2 120 206 | A | 11/1983 |
| JP | 04-308142 | A | 10/1992 |
| JP | 06-127757 | A | 5/1994 |
| JP | 06-156821 | A | 6/1994 |
| JP | 3133430 | U9 | 7/2007 |
| WO | WO 2008/048151 | A1 | 4/2008 |

*Primary Examiner* — Sang Kim

(74) *Attorney, Agent, or Firm* — Kimberly-Clark Worldwide, Inc.

(57) ABSTRACT

Coreless rolls of tissue, such as rolls of bath tissue or paper towels, are produced by winding tissue logs on a mandrel having retractable pins. During winding, the pins extend and penetrate the first several windings of the log as it is initially wound, which prevents slippage. After the winding is complete, the pins retract to allow the tissue log to slide off of the mandrel for subsequent slitting into individual product rolls and packaging. The penetration of the pins into the first several windings of the log tends to mechanically entangle and structurally unify those windings to create a "soft core". At the same time, the properties of the tissue sheets within the soft core are the same as the other sheets within the roll and are therefore usable by the consumer.

20 Claims, 5 Drawing Sheets

CORELESS TISSUE ROLLS

RELATED APPLICATIONS

The present application is a continuation application and claims priority to U.S. patent application Ser. No. 12/606,515, filed on Oct. 27, 2009, which is incorporated herein by reference.

BACKGROUND OF THE INVENTION

Most rolled products, such as bath tissue and paper towels, are made with cores, which serve not only as a base upon which the product sheets are wound during manufacturing, but which also enable the rolled product to be operatively positioned for use by the consumer. For example, rolls of bath tissue or paper towels consist of a continuous length of product, divided into individual product "sheets" separated from each other by transverse lines of perforations. The product rolls are typically mounted on a spindle for dispensing. In the case of bath tissue products, the spindle is typically horizontally oriented, while for paper towels the spindle can be either horizontal or vertical. In all cases, the core of the rolled product easily fits over the dispensing spindle and allows the roll of product to freely rotate. Such cores are commonly made of spirally-wound cardboard strips, which are glued together where the strips overlap each other. While cores serve a useful purpose, they add materials costs to the product and are perceived by some as being environmentally wasteful since the core is thrown away by the consumer after the product is used up. When product containing cores is recycled at the factory the core causes specks in the basesheet from the brown fiber of the core and the glue used to make the core and attach the leading edge of the paper to the core.

In response to the disadvantages of conventional cores, coreless rolled bath tissue products have been produced, but not without their own disadvantages. While they eliminate the cost of core materials and the associated glue, some coreless processes add starch or water in excessive quantities to the sheet of product in the windings closest to the center of the roll to stiffen the sheets so they can retain the shape of the hole necessary for the consumer to be able to easily slide the product roll over the spindle prior to use. Unfortunately, this approach adds its own costs (starch/water application) and has the inherent disadvantage of making the stiffened product sheets undesirable or unusable (about 15-20 sheets). Alternatively, some coreless products are wound around a very small diameter mandrel, which results in more useable product than products with a large hole, but also results in a small irregularly-shaped center hole which requires a special adapter to enable the roll to be mountable on a conventional spindle. Other coreless product is provided with no hole whatsoever and a pin is required to adapt to current dispensers.

Therefore there is a need for a coreless tissue product roll which easily fits over conventional dispensing spindles and which does not significantly degrade the properties of the last few sheets on the roll so they are still usable.

SUMMARY OF THE INVENTION

It has now been discovered that coreless rolled tissue products, such as bath tissue and paper towels, can be made with a conventionally-sized hole without the need for using sheet-stiffening chemicals which adversely impact the properties of the last sheets on the roll. As a result, all of the sheets on the roll can be used by the consumer. Properties of the sheets that are unaffected by the present invention include sheet bulk, softness, tensile strength, absorbency, and the like. These products can be produced using specially-modified coreless winding mandrels which are designed to replace the winding mandrels commonly used for winding cored tissue product rolls. As a result, coreless products can be produced using existing winders by simply substituting the coreless winding mandrels of this invention for the conventional mandrels.

Hence in one aspect, the invention resides in a coreless roll of tissue comprising a plurality of windings emanating from an axially-oriented central open area and terminating on the outside of the roll, wherein two or more consecutive windings closest to the central open area have registered perforations.

In another aspect, the invention resides in a method of winding a length of a tissue web onto a mandrel to form a coreless roll of tissue, said method comprising: (a) providing a rotating mandrel with retractable pins, said pins being extended from the surface of the mandrel; (b) bringing the tissue web into contact with the mandrel, whereby the tissue web is perforated by the extended pins; (c) winding the tissue web around the mandrel, such that the pins perforate two or more windings of the resulting roll of tissue, thereby forming a soft core; (d) retracting the pins within the mandrel; and (e) removing the resulting wound roll from the mandrel.

In another aspect, the invention resides in a coreless winding mandrel comprising retractable "pins" (hereinafter described).

For purposes herein, a "coreless" roll is one which does not have a separate, relatively rigid, independent, non-tissue core component, such as a cylindrical cardboard core used for typical commercially available tissue products. Instead, the coreless rolls in accordance with this invention have what is sometimes referred to herein as a "soft core", meaning the windings of tissue surrounding the central opening area of the roll are flexible and collapsible, yet provide the central opening with sufficient integrity to enable the user to insert a dispensing spindle into the open area to support the roll during use. The soft core has the additional characteristic that each sheet within the soft core can be used by the consumer and has essentially the same properties as the other sheets in the roll. The soft core has the additional characteristic of allowing subsequent machine operations to occur, such as tail sealing, log sawing, packaging, overwrapping, palletizing and distribution with minimal damage to the hole.

For purposes herein, "registered perforations" are holes in adjacent windings that completely overlay each other or at least overlap each other. When present in more than two windings, the holes align linearly with each other in a radial direction of the roll. For purposes herein, a linear sequence of adjacent registered perforations is referred to as a "line of registered perforations". As will be described herein, these registered perforations and lines of registered perforations are created by the penetration of consecutive windings by retractable "pins" protruding from the surface of the mandrel as the continuous tissue basesheet is wound around the mandrel. The result of these lines of registered perforations is that the initial windings of the tissue sheet around the mandrel are effectively "needle-punched" together to form a soft core, giving the initial windings, as a group, sufficient structural integrity to maintain a conventionally-sized hole in the roll after it is removed from the winding mandrel. At the same time, since no stiffening chemicals are necessarily applied to the sheet during the initial winding of the roll on the mandrel, the last few sheets on the roll remain soft, flexible and usable. As the finished product roll is unwound down to the last few sheets, the exposed outer winding of the "needle-punched" windings easily separates from the others as the consumer unwinds the roll until it is used up. The small holes left in the sheets created by the penetration of the pins do not adversely affect the performance of the sheets for the consumer.

For purposes herein, the "pins" are sharp, pointed, generally elongated tapered structures that are capable of piercing at least two windings of a tissue web. In general, the base of the pin needs to be sufficiently large to provide the necessary strength needed to withstand the demands of high speed commercial manufacturing, where the mandrels rotate at speeds of from about 3000 to about 6000 revolutions per minute depending on sheet speed and mandrel diameter. The tips of the pins, which must also have sufficient strength and durability, are as sharp as reasonably possible in order to easily punch through sheets of tissue during the winding operation. In cross-section, the pins can be any shape, such as round, elliptical, square, triangular, etc. The length of the pins, as measured from the surface of the mandrel to the tip of the pin, can be from about 0.10 to about 0.40 inch. The base of the pins can be from about 0.10 to about 0.3 inch in width. Testing has shown that the tip of the pin needs to be sharp to penetrate the sheet. Suitable shapes for the pin would be a pyramid or a cone ending at a tip. In all cases the pin tapers in all directions to a point. A frustum of a pyramid or cone, where the tip has a significant width, would not be suitable for use as a pin because such structures would not penetrate more than one sheet, if at all. By way of example, a typical pin suitable for purposes herein will have a point comparable to that of the transfer pins currently used in the bedroll of rewinder lines, such as those manufactured by the Paper Converting Machine Company, Green Bay, Wis. Another more common example is that the sharpness of the pin would be similar to a common safety thumb tack. A suitable material for making the pins includes spring steel hardened to about 40 on the Rockwell "C" scale. This level of hardening provides good durability and wear resistance.

The number of consecutive windings that have lines of registered perforations can be from 2 to about 40, more specifically from 2 to about 30, more specifically from 2 to about 25, more specifically from about 5 to about 25, and still more specifically from about 5 to about 15. For a pin having a length of about 0.2 inch, for example, the number of consecutive windings that will be perforated can range from about 14 to about 25, depending upon the bulk and caliper of the tissue sheet. The number of windings having registered perforations will also depend upon the distance the protruding pins extend above the surface of the mandrel, the tension of the sheet and the strength of the sheet. In order to prevent slippage of the building roll (commonly referred to as "log") over the mandrel as the roll is being wound, it is believed at least two windings must be perforated by the pins. The pins are also used to transmit torque from the winding mandrel to the winding roll to control the tightness of the wind and to build a roll with the required finished diameter and firmness. The greater the number of windings that are perforated, the greater the degree of entanglement of the perforated windings, which serves to loosely associate the affected windings to effectively create a soft core. As previously mentioned, an advantage of such soft cores is that the properties of the final sheets on the roll are relatively unaffected and the perforated windings easily disassociate themselves from each other as the roll is unwound. Consequently, the consumer can use all of the sheets on the roll. At the same time, such soft cores have sufficient integrity to substantially maintain a hole in the center of the roll that can easily be manipulated by the consumer to accept a dispenser spindle. It has also been found that a small amount of water on the surface of the sheet enhances the entanglement of the fibers increasing the strength of the soft core while not having any effect on the ability to use the final sheet on the roll.

In order to maintain stability of the winding mandrel when rotating at high speeds, it is necessary to keep the mandrel in balance. An effective way to maintain rotational balance is to provide retractable pins on diametrically opposite sides of the mandrel (180° apart). Advantageously, this also results in lines of registered perforations that are diametrically opposite each other in the wound log, which enhances the integrity of the soft core. A greater number or frequency of registered perforations in the centrally-located inner windings of the roll correlates with greater mechanical bonding among the windings and accordingly increased structural integrity of the resulting soft core. Similarly, three retractable pins can be equally spaced-apart in the circumferential direction of the mandrel (every 120°) to provide equally spaced-apart lines of registered perforations in the circumferential direction of the wound log.

In addition, a plurality of lines of registered perforations spaced-apart in the axial direction of the central open area of the wound log can be created by providing corresponding multiple retractable pins spaced apart along the length of the winding mandrel. The axial direction spacing of the lines of registered perforations can be from about 0.5 to about 2 inches, more specifically from about 0.5 to about 1.5 inches, and still more specifically from about 0.5 to about 1 inch. An axial direction pin spacing of about 0.75 inch has been determined to be particularly suitable, since this corresponds to the spacing of the transfer pins in the bedroll already holding the leading edge of the sheet. The spacing of the retractable pins and the corresponding resulting lines of registered perforations will influence the stability of the winding operation and the structural integrity of the resulting soft core of the log and the individual final product rolls cut from the log. Since bath tissue product rolls typically have a width of about 4 inches, it is highly desirable to have at least two lines of registered perforations or two pairs of lines of registered perforations spaced-apart in the axial direction of the product roll, more specifically from about 2 to about 8, and still more specifically from about 3 to about 5, in order to provide sufficient soft core integrity along the majority of its length.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

BRIEF DESCRIPTION OF THE DRAWINGS

FIG. 4A depicts the "bullet" end of the mandrel. FIG. 4D depicts the opposite "button" end of the mandrel. FIG. 4B is a representative middle section of the mandrel with the retractable pins extended and FIG. 4C is a representative middle section of the mandrel with the retractable pins retracted.

DETAILED DESCRIPTION OF THE DRAWINGS

Referring to the various Figures, the invention will be described in greater detail. The use of the same reference number in more than one Figure is intended to represent the same feature unless otherwise stated.

Figure 1:
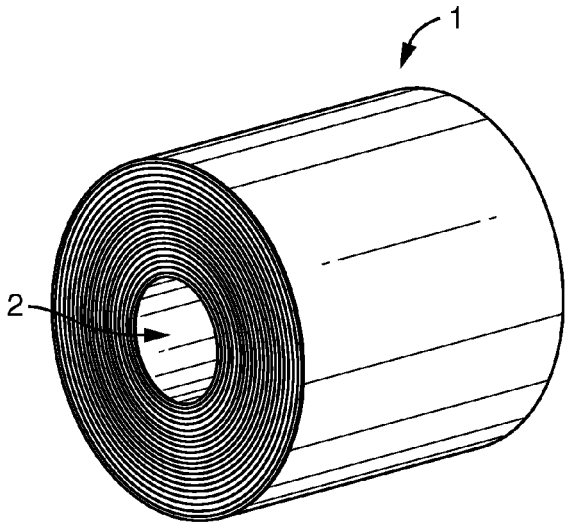
FIG. 1 is a schematic perspective view of a coreless bath tissue roll product in accordance with this invention.

FIG. 1 is a perspective schematic view of a coreless roll of bath tissue in accordance with this invention. Shown is the roll 1 and the central open area or hole 2 which is suitable for receiving a dispensing spindle.

Figure 2:
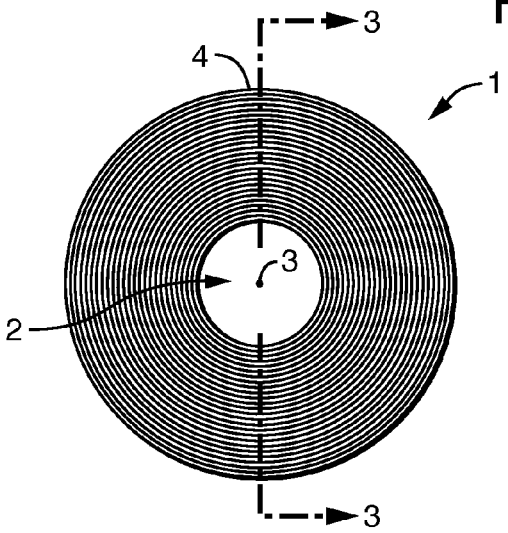
FIG. 2 is a schematic side view of a coreless roll of bath tissue, such as that shown in FIG. 1, further generally illustrating the windings of the continuous tissue sheet and the central open area.

FIG. 2 is a schematic side or end view of the roll of FIG. 1, further illustrating the central open area 2 and the center axis 3 of the roll. The roll is spirally wound from the hole in the center of the roll to the outside, but effectively the roll can be thought to consist of a large number of windings, which are the individual layers or sheets between the axis and the outer surface 4 as measured along a radial direction. A single winding represents the sheet being wound once around the roll. Typically, bath tissue rolls made from through-air dried tissue have from about 150 to about 250 windings per roll. The actual number of windings will depend upon the sheet count and the thickness of the tissue sheets, but these are typical values for commonly made products available for consumers. Similarly, single-ply paper towels made from through-air dried tissue have from about 50 to about 150 windings per roll. The central open area, as viewed in cross-section, can be irregularly-shaped and need not be perfectly round, although it can be substantially round. However, when manipulated by the user, the central open area is sufficiently large to accommodate a dispensing spindle. As such, the perimeter of the central open area can be from about 1 to about 5 inches, more specifically from about 1.5 to about 5 inches, more specifically from about 2 to about 5 inches, and still more specifically from about 2 to about 4 inches.

Figure 3:
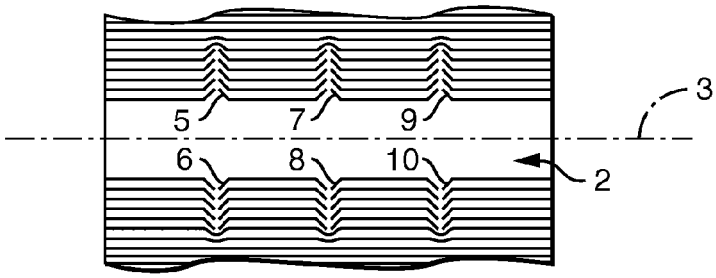
FIG. 3 is a schematic partial sectional view of the roll of FIG. 2, illustrating the concept of "registered perforations" near the central opening, which mechanically connect adjacent windings together to create a "soft" core.

FIG. 3 is a schematic sectional representation of the windings in the vicinity of the central open area of a roll of tissue taken along line 3-3 of FIG. 2, including the windings which can form the soft core in accordance with this invention, illustrating the concept of "registered" perforations and "lines of registered perforations". For purposes of illustration, the sectional view is conveniently taken in a plane in which the registered perforations are present. Each perforation is illustrated as a break in the winding. The windings illustrated are not to scale and represent just a fraction of the many windings that are found in a typical roll of bathroom tissue or towel product. More specifically, as shown, each of the first five windings of the roll has six lines of registered perforations 5, 6, 7, 8, 9 and 10 spaced apart in the axial direction of the roll and which form straight lines in the radial direction of the roll. In this embodiment, each line of registered perforations 5, 7, and 9 has a corresponding line of registered perforations 6, 8 and 10, respectively, positioned diametrically opposite from its location in the roll. These diametrically opposite pairs of lines of registered perforations are created by pins located diametrically opposite each other on the surface of the winding mandrel.

Figure 4A:
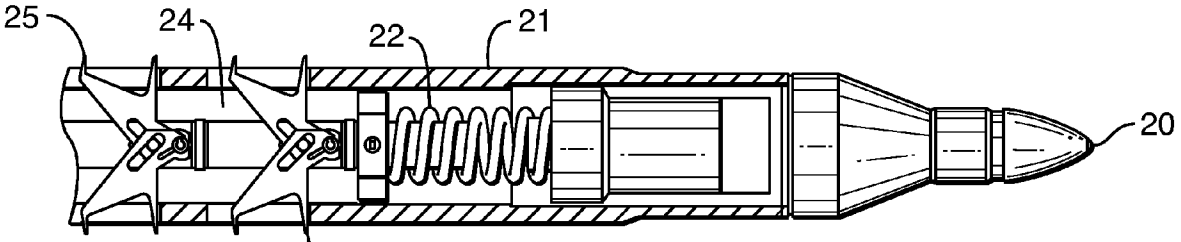
FIGS. 4A, 4B, 4C and 4D are lengthwise cross-sectional views of representative segments of a winding mandrel in accordance with this invention.
Figure 4B:
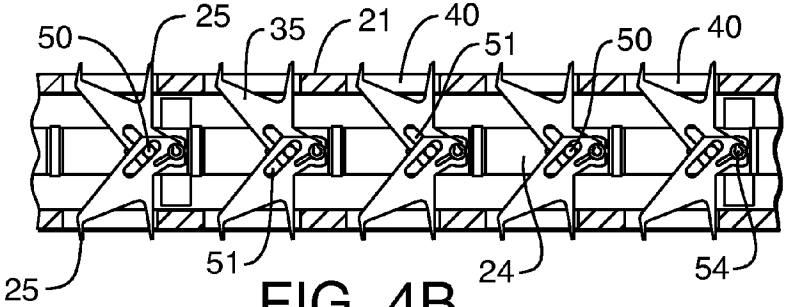
Figure 4C:
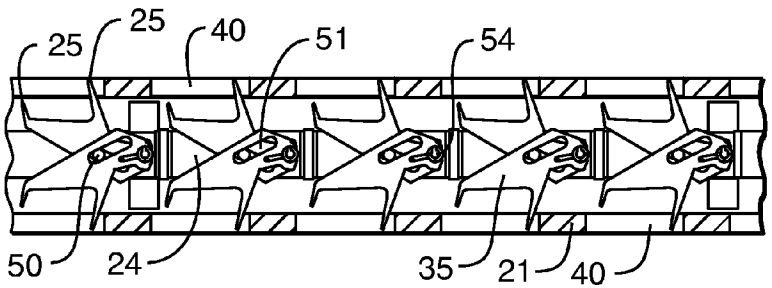
Figure 4D:
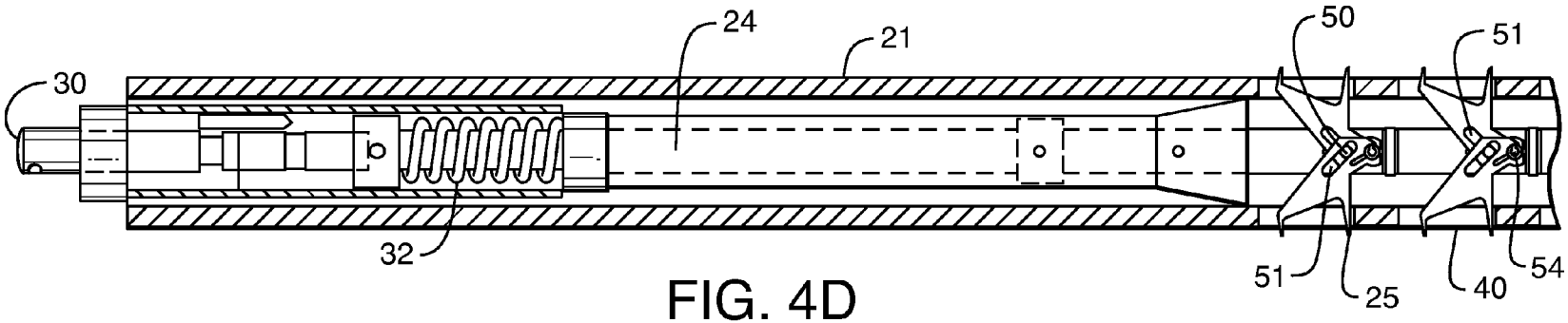
Figure 5A:
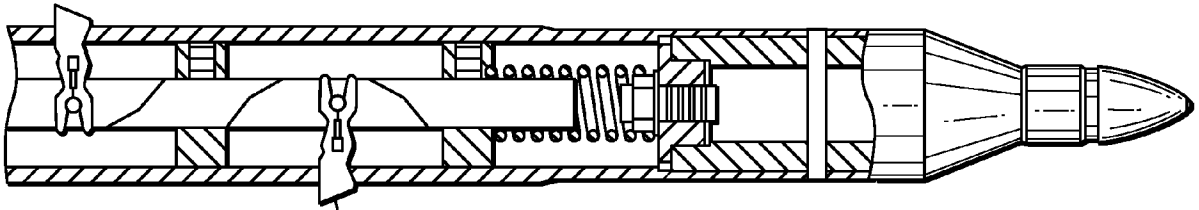
FIG. 5A (PRIOR ART)
FIGS. 5A, 5B, 5C and 5D are lengthwise cross-sectional views of representative segments of a conventional cored winding mandrel, similar to the views of FIGS. 4A-4D, but illustrating the differences between the "dogs" of the conventional mandrel and the pin-containing dogs of the mandrels of this invention.
Figure 5B:
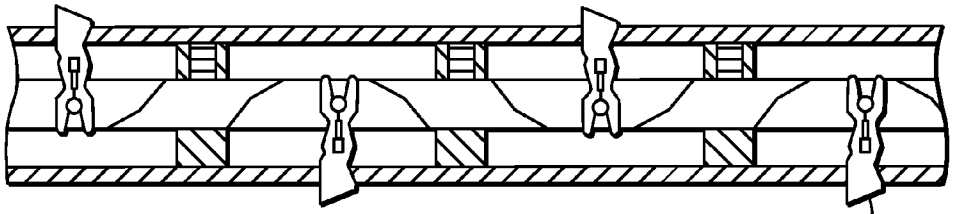
FIG. 5B (PRIOR ART)
Figure 5C:
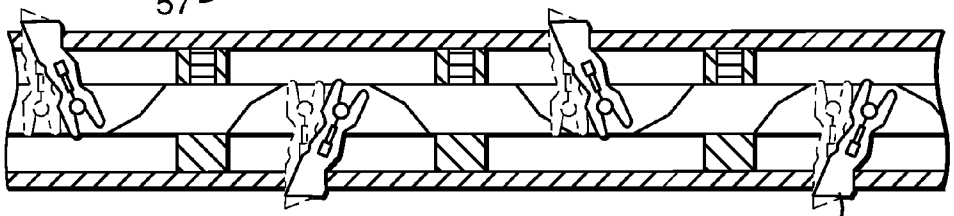
FIG. 5C (PRIOR ART)
Figure 5D:
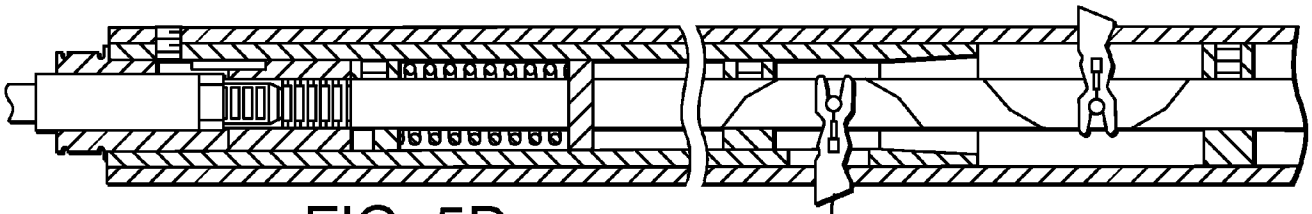
FIG. 5D (PRIOR ART)

FIGS. 4A-4D illustrate representative segments of a winding mandrel in accordance with this invention. FIG. 4A illustrates the "bullet" end of the winding mandrel. FIG. 4D represents the opposite end of the mandrel, referred to herein as the "button" end. FIG. 4B illustrates a middle segment of the mandrel with the retractable pins in the extended position in order to form the lines of registered perforations as illustrated in FIG. 3. FIG. 4C illustrates the middle segment of the mandrel of FIG. 4B with the retractable pins in the retracted position for removal of the wound tissue log. It will be appreciated that during operation, all of the retractable pins in the middle section of the mandrel will act in unison as they extend or retract. Since many of the features of the mandrel repeat along the length of the mandrel, reference numbers and lead lines in the Figures are only applied to a few of the repetitive features, and not all of them, to maintain the clarity of the Figures.

More specifically, referring to FIGS. 4A and 4D, shown in FIG. 4A is the bullet end 20 of the mandrel, which is cupped by a bearing during winding, which allows the wound tissue log to be removed in the log strip position of the winder. The outer surface of the mandrel is generally formed by tube 21, which houses the internal components of the mandrel. The tube preferably has a grooved surface having multiple lengthwise (axial direction) grooves, similar to a splined shaft, in order to reduce frictional contact between the inner surface of the wound tissue log and the surface of the mandrel tube when the wound tissue log is stripped from the mandrel. In general, the depth of these axial grooves can be from about 0.1 to about 0.3 inch while ensuring that adequate wall thickness remains for the structural integrity of the mandrel tube. The width can be from about 0.2 to about 0.5 inch. The number of grooves around the perimeter of the tube can be from about 6 to about 18. An even number of grooves is beneficial to help balance the position of the holes or slots through which the pins protrude. Additional deeper or wider axial grooves are also beneficial on at least one side of the row of pins (on the leeward side of the row of pins relative to the direction of rotation of the mandrel) to provide room for several thicknesses of the tissue web that are folded over each other during the transfer in the winding process (see FIG. 5). The depth of these leeward grooves can be from about 0.1 to about 0.3 inch. The width of these leeward grooves can be from about 0.2 to about 0.6 inch. Preferably one spline is removed to create this wider groove. The bullet end of the mandrel includes a bullet end spring 22 that wraps the end of the central shaft 24. The central shaft is moveable relative to the tube 21 in the axial direction in order to cause the pins 25 to extend and retract with cam action as hereinafter described.

FIG. 4D shows the opposite end of the mandrel, referred to as the button end. Shown are the button 30, which is provided with adjustment capability, and the button end spring 32, both of which serve to controllably move the central shaft 24 in the axial direction of the mandrel when the button 30 is pressed inwardly. During winding, the balance of forces provided by the button end spring 32 and the bullet end spring 22 serve to maintain the central shaft 24 in a default position that leaves the retractable pins 25 in an extended position. When the winding of the tissue log is complete, the button 30 is depressed to move the central shaft 24 in the axial direction of the bullet end, thereby retracting the pins until the button is released. Pins may also be retracted temporarily immediately after winding the bottom layers to prevent tension changes in the sheet leading to sheet breakage. This mechanism will be further described in connection with FIGS. 4B and 4C below.

FIG. 4B illustrates a middle segment of the mandrel with the pins 25 in the extended position for winding. For purposes herein, the moveable, flat metal structure from which the pins extend is generally referred to as a "dog", which is designated by reference number 35. As shown, the tube 21 has appropriately positioned openings or slots 40 which are machined into the tube to allow the pins of the dogs to extend beyond the plane of the surface of the tube. In this embodiment, each dog has two pins, although any number of pins can be provided. As shown, an axial row of pins and the corresponding slots in the tube are arranged 180° apart around the circumference of the tube in order to maintain balance of the assembled tube when the mandrel is rotating at high speeds during winding. Fixed cam posts 50 are attached to and traverse the tube 21 as they pass through a cam slot 51 in the dogs. Two dogs are arranged on each cam post. It can be seen that the cam post has the added benefit of retaining the dog in the mandrel to prevent it from falling out and getting into the product if it should come loose. The other end of the dog is fixed to the central shaft 24 using a round pin 54. When the actuating button is pressed, this overcomes the default return spring pressure and moves the central shaft 24 axially relative to the tube 21 of the mandrel in a similar manner to the conventional cored mandrel. The relative motion between the round pin 54, which is moving along with the central shaft 24, and the fixed cam post 50 causes the cam slot 51 of each dog to slide on the cam post and rotate the dog around the round pin 54, thereby retracting the pins 25 through the slots 40 in the tube 21 of the mandrel in order to allow the wound tissue log to be stripped by the log stripper. This retracted position of the pins is illustrated in FIG. 4C. The button position can be adjusted to set the retraction position of the pins 25.

Those skilled in the art will appreciate that other various means can be used to extend and retract the pins of the winding mandrel. Such other means include electrical actuation, where a solenoid would operate the dogs, or hydraulic action, where the motion of the button provides hydraulic pressure to retract and extract the pins. Pneumatic retraction can be done using a bladder to extend the pins and using springs to retract each pin. For example, the movement of the actuating button can be translated to rotary motion within the mandrel using a lead screw with a shallow angle, such as a miniature rolled ball screw assembly. In such an embodiment, the coreless mandrel includes an internal central shaft which can move in a rotary motion relative to the outer tube. As with the coreless mandrel described above, two opposing springs are used, one on the button end and one on the bullet end arranged such that the resultant force keeps the button extended and the pins out. When the actuating button is pressed to retract the pins, the axial motion of the button presses on the lead screw, which changes the axial motion into rotary motion, thereby turning the central shaft. The pins are fixed to discs such that the rotary motion of the central shaft pulls the pins inside the tube of the mandrel, allowing the log to be stripped. Adjustments to the amount of button travel or initial settings allow the extension and retraction positions to be set and controlled to the desired amount.

To ensure that the sheet remains on the pins after transfer, the pins can be angled in the direction of travel relative to a radial line from the central axis of the mandrel. Preferably, curved pins are used such that the tip of the pin is curved in the direction of rotation of the mandrel, which is a curvature in the direction of rotation away from a radial line drawn from the center of rotation of the mandrel. The resultant force of tension and pin geometry then tend to keep the sheet against the surface of the mandrel. The axial width of the pin increases after this point to ensure that the pin is not prone to breakage from incidental contact with the transfer roll or from material fatigue from operation. It can be seen that the thickness of the pin in the radial direction can also be adjusted to give the best combination of thickness and width to ensure a long life for the pin and reduced risk of breakage. The pin is made from hardened steel to retain the sharp point as tissue paper is known to be abrasive. It is beneficial to have the center of gravity of the pin close to the centerline of the mandrel so it is easier to retract the pin while operating at high rotational speed if necessary.

Those skilled in the paper converting arts will easily understand the operation of the mandrels of this invention insofar as the mandrels of this invention, despite significant design differences, generally operate similarly to those used for making conventional cored bath tissue and paper towels. For comparison, a conventional cored mandrel is illustrated in FIGS. 5A-5D. In particular, conventional cored mandrels also have a spring-operated bullet end, a spring operated button end, and have "dogs" which extend and retract from the surface of the mandrel. However, the dogs of conventional mandrels have relatively blunt ends 57 or gripping surfaces that are designed to frictionally grip and hold the core in place during winding by pushing out on the inside surface of the core. The pressure of the dogs on the inside of the core also tightens the core against the mandrel tube. It is not desirable to puncture the core material with the dogs because a punctured core is subject to failure during transfer and winding, which damages the tissue log. Consequently, the shape of conventional dogs and their positions along the length of the mandrel, as well as their purpose, is different than that of the pin-containing dogs of the mandrels useful for this invention. In use, the default position of the conventional dogs is at maximum extension (FIGS. 5A, 5B and 5D) from the surface of the mandrel, pressing against the inner surface of the core and thus frictionally engaging the core so that the core will not slip during the winding of the paper onto the core. When the core is put onto the mandrel or when the log is stripped from the mandrel, the dogs are rotated by pressing the button on the end of the mandrel using an external cam that is placed in both the log strip and core load positions of the winding turret. One end of the dogs is attached to the central shaft such that the change in angle of the dog changes the orientation of the gripping surface of dog to be level with the surface of the mandrel (FIG. 5C), thereby allowing the log to be stripped or the core to be installed.

Figure 6:
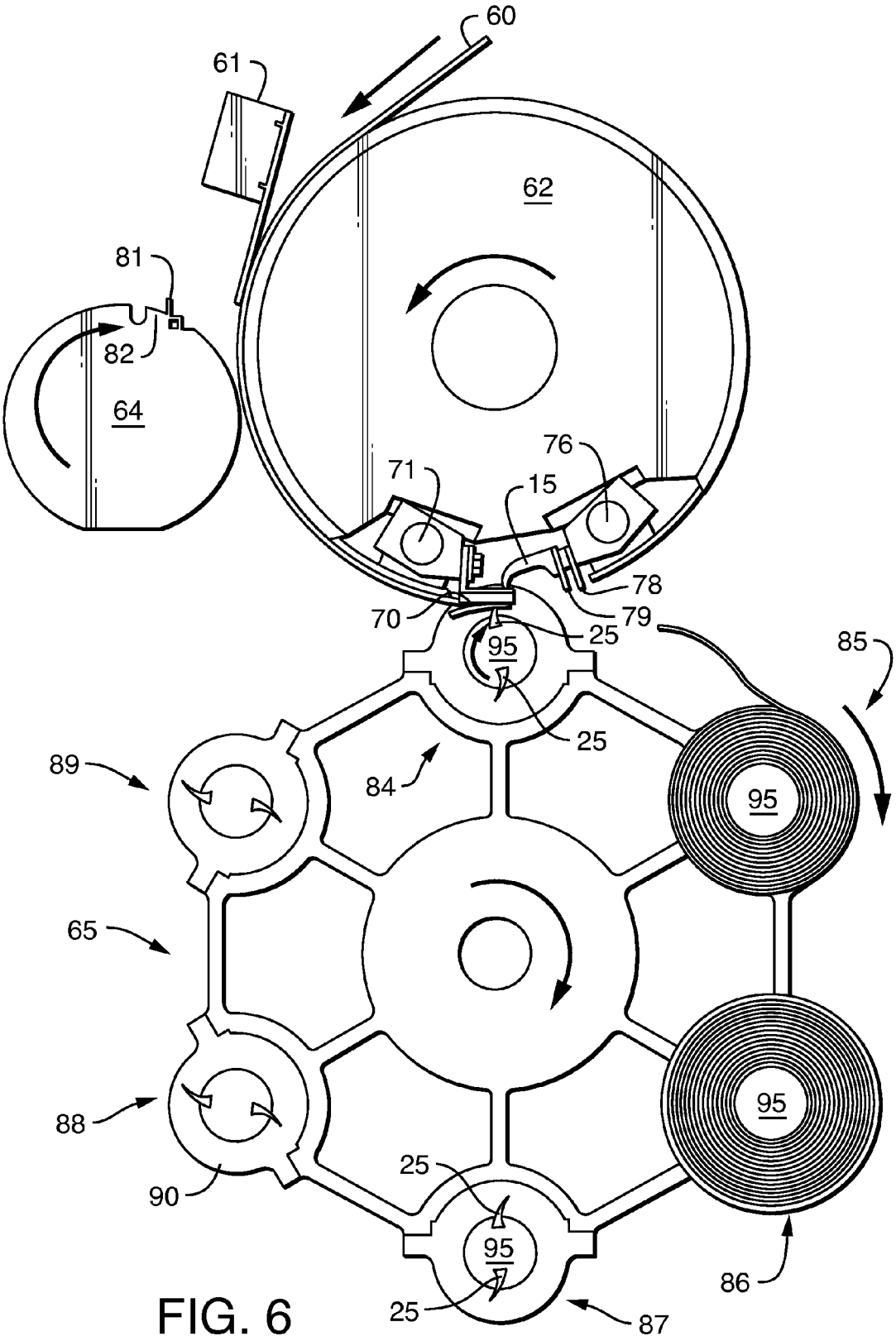
FIG. 6 is a schematic view of a conventional rewinder using the coreless winding mandrels of this invention instead of the conventional cored winding mandrels.
Figure 7:
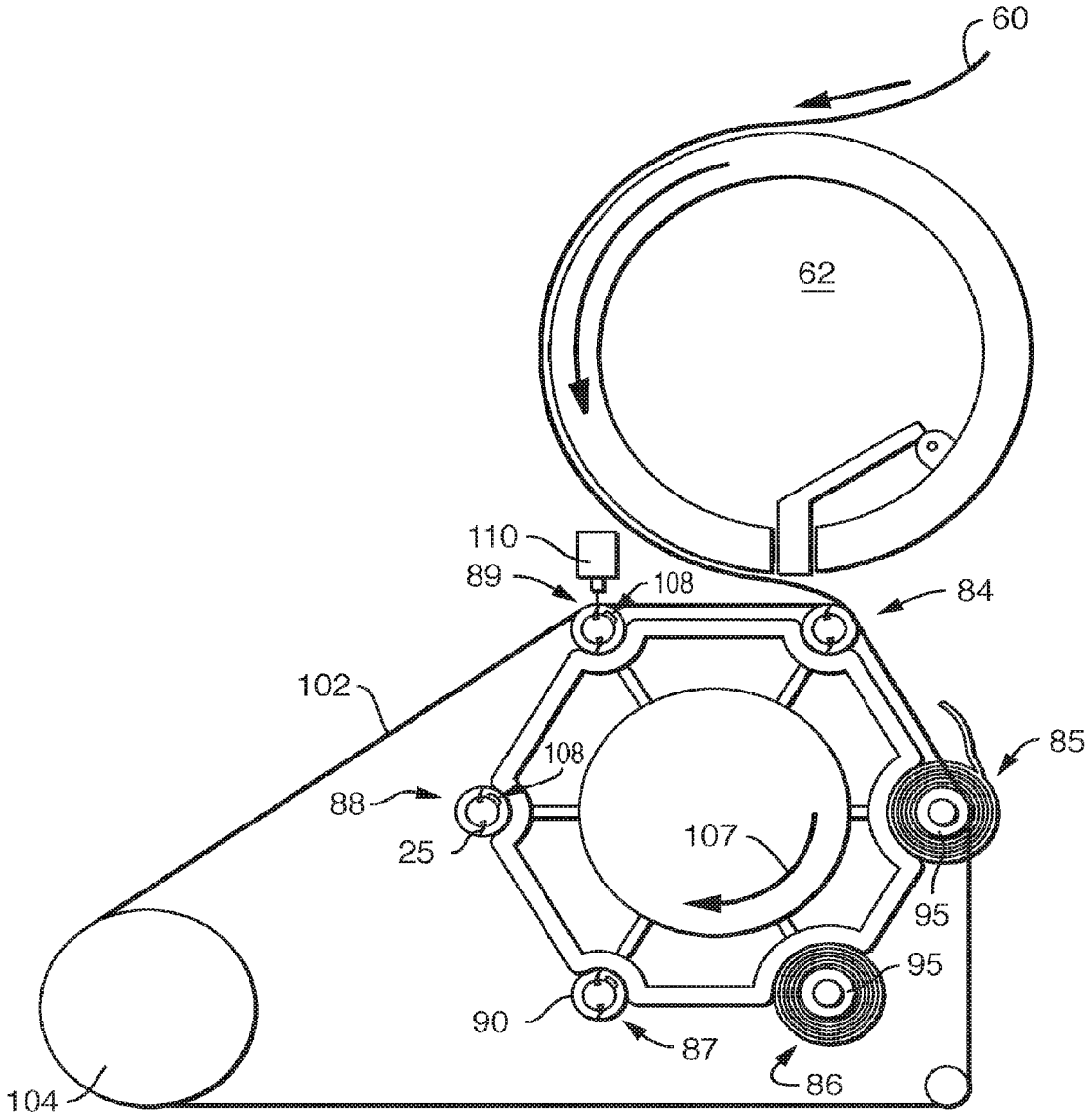
FIG. 7 is a schematic view of a rewinder using the coreless winding mandrels of this invention.

To place the operation of the mandrels of this invention in context, FIG. 6 illustrates a conventional rewinder, at the moment of web transfer, (where the turret is in motion) in which the mandrels of this invention can be used. As previously mentioned, the mandrels of this invention essentially replace the conventional cored mandrels of the rewinder to enable the same rewinder to produce coreless rolls of tissue with minimal structural modifications. Shown in FIG. 6 is the incoming web 60, the fingers 61, the rotating bedroll 62, the chopper roll 64, and the turret 65. The bed roll 62 contains a transfer pad 70 which moves as the supporting structure pivots around the transfer pad pivot 71. Also shown is the transfer pin 75 which moves in and out as the supporting structure pivots about the pin pivot 76. Also shown are a pair of bedroll blades 78 and 79, which are associated and move with the transfer pin 75. The chopper roll 64 contains a chopper blade 81 and a chopper pad 82. The turret 65 contains six stations (84, 85, 86, 87, 88 and 89), each of which contains a bearing block 90 that supports the mandrel 95 for rotation. The pins 25 of the mandrel are illustrated as being slightly curved in the direction of rotation, which can be advantageous for improved gripping and penetration of the tissue web as previously mentioned.

In normal winding operation, the transfer pad 70 and the transfer pin 75 are retracted into the bedroll and do not interfere with the sheet path. The mandrel in position 84 is brought up to the surface speed of the web. When transfer is initiated the transfer pin 75 is rotated about pivot 76. The bedroll blades 78 and 79 push the web 60 towards the chopper blade 81 severing the web 60. At the same time the chopper pad 82 pushes the sheet onto the transfer pins 75. The rotational speeds of the chopper roll 64 and the bedroll 62 are timed such that the web is cut to the appropriate length. FIG. 6 is a snapshot in the point of time where the web has been cut and is beginning to transfer to the mandrel at station 84. As shown, the leading edge of the cut web folds back on itself. The transfer pad 70 is then rotated about pivot 71 while the transfer pin 75 is retraced pushing the sheet onto the pins 25. This penetrates and grips the leading edge of the web and begins winding the tissue log. Note that the position of the mandrel pins is phased to match the position of the transfer pins. Since there are only two sets of pins around the circumference of the mandrel, it is important to have the pins 25 in the same vicinity of the transfer pins 75 to ensure good transfer and to maintain control of the sheet.

Station 85 shows the wound log with the trailing edge of the web about to be tail tacked to complete the log. Tail tacking can also occur outside the winder at a separate downstream station. Station 86 shows the completed log about to be removed from the mandrel by the log stripper. The coreless mandrels of this invention advantageously use the same arrangement as current mandrels where the button is used to retract the dogs to allow the log to be stripped. A different retraction mechanism can be used if this is beneficial, for example, if the required stroke is higher than the typical button stroke for a cored mandrel or if the retraction of the pins is needed immediately after transfer to prevent sheet breakage. Stations 87, 88 and 89 show a bare mandrel after the log has been stripped awaiting to approach the winding station. In a conventional cored operation, stations 88 and 89 would be for introducing the core over the cored mandrel and applying adhesive to the surface of the core prior to winding. Since these steps are unnecessary for purposes of this invention, these stations are simply occupied by coreless mandrels as shown.

Since the coreless winding mandrels of this invention replace the conventional winding mandrels used in a typical winder, control programming that is used to detect the presence of a core is disabled to permit the winder to operate. As noted above, the existing button can be used to disengage the pins for log stripping after the roll is wound, but alternative methods can be used to disengage the pins in the log stripping position. Another option is to disengage the pins immediately after transfer to prevent the pins from ripping subsequent wraps of the sheet. It has been found to be advantageous to update the control of the mandrel drive to be able to detect the position of the mandrel such that the pins position is coincident with the transfer pins in the bedroll at the moment of transfer ("phasing"). Since the mandrel drive system is operated by a flat belt 102 and the mandrel 95 is disengaged from the belt 102 at the log strip and core load positions in the turret, a reference marker 108 is provided on the end of the mandrel 95 and a sensor 110 is used to detect the position of the mandrel 95 when the flat belt 102 is reengaged. The position of the reference marker 108 is detected and the position of the mandrel 95 adjusted by the drive motor 104 such that the pins 25 of the mandrel will be in phase with the transfer pins 75 in the bedroll 62. This will ensure the best transfer of the sheet 60 from the transfer pins 75 to the mandrel 95. It is also advantageous to have a reference mark for each set of pins to minimize the time for phasing. For example, if there are two rows of pins, there would be two reference marks on the mandrel corresponding to each row of pins.

It will be appreciated that the foregoing description and drawings, given for purposes of illustration, are not to be construed as limiting the scope of this invention, which is defined by the following claims and all equivalents thereto.

We claim:

1. A method of winding a moving web upon a mandrel comprising:

conveying a moving web having a leading edge;

providing a mandrel, the mandrel being adapted to adhere the moving web at a specific circumferential location on the mandrel, the mandrel further including a reference marker to identify the specific circumferential location;

engaging the mandrel with a position drive control to control the rotational speed of the mandrel;

determining the position of the reference marker with a position sensor;

setting the rotational speed of the mandrel to allow transfer of the leading edge of the moving web near the specific circumferential location;

transferring the moving web to the mandrel near the specific circumferential location; and winding the moving web.

2. The method of claim 1 wherein the mandrel is a coreless mandrel having grooves on the surface running in the axial direction of the mandrel.

3. The method of claim 1 wherein the mandrel comprises a plurality of pins spaced along the length of the mandrel.

4. The method of claim 3 wherein one or more of the pins comprise a reference marker.

5. The method of claim 3 wherein the pins are retractable.

6. The method of claim 3 wherein the pins are angled relative to the radial direction of the mandrel.

7. The method of claim 3 wherein the pins are equally spaced 180° apart around the circumference of the mandrel.

8. The method of claim 1 wherein the step of transferring the moving web to the mandrel is carried out by vacuum.

9. The method of claim 1 wherein the step of winding the moving web yields a rolled product.

10. The method of claim 9 further comprising the step of cutting the moving web to complete the rolled product.

11. The method of claim 10 further comprising the step of stripping the rolled product from the mandrel thereby producing a coreless rolled product.

12. The method of claim 11 wherein the web is a tissue web and the coreless rolled product is a coreless rolled tissue product.

13. An apparatus for winding a moving web upon a mandrel comprising:

a conveying surface for conveying a moving web;

a mandrel, the mandrel being adapted to receive the moving web at a specific circumferential location on the mandrel, the mandrel further including a reference marker to identify the specific circumferential location;

a position sensor to determine the position of the reference marker; and a position drive control to control the rotational speed of the mandrel.

14. The apparatus of claim 13 wherein the mandrel is a coreless mandrel having grooves on the surface running in the axial direction of the mandrel.

15. The apparatus of claim 13 wherein the mandrel comprises a plurality of pins spaced along the length of the mandrel.

16. The apparatus of claim 15 wherein the pins are retractable.

17. The apparatus of claim 15 wherein the pins are angled relative to the radial direction of the mandrel.

18. The apparatus of claim 15 wherein the pins are equally spaced 180° apart around the circumference of the mandrel.

19. The apparatus of claim 15 wherein the pins are equally spaced 120° apart around the circumference of the mandrel.

20. The apparatus of claim 13 further comprising a vacuum means for transfering the a moving web to the mandrel.

* * * * *